United States Patent [19]

Demarest, Jr.

[11] Patent Number: 5,042,771

[45] Date of Patent: Aug. 27, 1991

[54] DOCUMENT HOLDER FOR CURRENT FILE REVIEW

[76] Inventor: Russell G. Demarest, Jr., 60 Forest Rd., Glen Rock, N.J. 07452

[21] Appl. No.: 605,670

[22] Filed: Oct. 29, 1990

Related U.S. Application Data

[63] Continuation of Ser. No. 426,559, Oct. 23, 1989, abandoned.

[51] Int. Cl.[5] ..... A47B 97/04

[52] U.S. Cl. ..... 248/451; 248/458; 248/456

[58] Field of Search ..... 248/456–458, 248/451, 455, 441.1, 918, 316.3, 450

[56] References Cited

U.S. PATENT DOCUMENTS

| | | | |
|---|---|---|---|
| 1,900,401 | 3/1937 | Scully | 248/458 X |
| 2,572,731 | 10/1951 | Keith | 248/457 |
| 2,865,132 | 12/1958 | Fleming | 248/456 X |
| 4,867,318 | 9/1989 | Robson | 211/89 X |

FOREIGN PATENT DOCUMENTS

| | | | |
|---|---|---|---|
| 7865 | of 1904 | United Kingdom | 248/450 |

*Primary Examiner*—Alvin C. Chin-Shue
*Attorney, Agent, or Firm*—Samuelson & Jacob

[57] ABSTRACT

A document holder has a tray for holding documents in the form of a stack of individual sheets, the tray being movable between a generally horizontal orientation in which the sheets are placed and retained in an organized stack, and a generally vertical orientation in which the sheets are presented for visual scanning and review, the document holder including restraining bars biased by gravity into position over the sheets in response to placement of the tray in the generally vertical orientation to maintain the stack of sheets in the tray during scanning and review, and into position away from the stack in response to placement of the tray in the generally horizontal orientation to enable access to the tray for easing placement of the sheets into the tray and removal of the sheets from the tray.

12 Claims, 3 Drawing Sheets

DOCUMENT HOLDER FOR CURRENT FILE REVIEW

This is a continuation of application Ser. No. 426,559, filed Oct. 23, 1989, now abandoned.

The present invention relates generally to document holders and pertains, more specifically, to a document holder which holds documents in the form of a stack of individual sheets for convenient, expeditious retention and review of the documents.

The retention and review of documents, at best, can be tedious and requires concentration and organization on the part of the person reviewing the documents in order to expedite the review. Various business and professional papers frequently become strewn over a work table or desk top and must be gathered and sorted by those responsible for the orderly process of review and disposition of the papers. So called "IN" and "OUT" trays are found on many desks and often are used for holding documents to be reviewed as a part of the function performed by the person at the desk. However, the task of visually scanning through a stack of papers retained in a common "IN" or "OUT" tray can be tedious, time-consuming and fraught with inaccuracies.

The present invention provides a document holder which holds a stack of documents for convenient and expeditious retention and review and which exhibits several objects and advantages, some of which may be summarized as follows: Permits documents to be held within easy reach and with maximum accessibility for review and further processing; promotes neatness and convenience in the processing of routine paperwork at a desk, table or other work station; enables ease of operation for expeditious review and handling of documents; provides a simplified construction readily adapted to a variety of document processing procedures for widespread economical use; relieves a large part of the tedium connected with document review for increased efficiency and accuracy; enables better organization of individual documents for retention and review; provides increased flexibility of use, enabling adaptation to the needs of a wide variety of document retention and review procedures; maintains an aesthetically pleasing as well as neat work space.

The above objects and advantages, as well as further objects and advantages, are attained by the present invention, which may be described briefly as a document holder for holding documents in the form of a stack of individual sheets selectively viewable from a viewing location forward of the stack, while being maintained in the stack, the sheets each having a length and a width defining a prescribed area, the document holder comprising: a tray having a receptacle for receiving the stack of sheets, the receptacle including an opening through which the sheets are passed into and out of the receptacle, the opening having an area great enough relative to the area of each sheet to be received within the receptacle so as to enable essentially uninhibited passage of the sheets through the opening into and out of the receptacle; orienting means on the tray for enabling the tray to be moved between a generally horizontal first position, wherein the opening is oriented generally horizontally and faces upwardly, so that the sheets may be dropped essentially downwardly through the opening into the receptacle, and a generally vertical second position, wherein the opening is oriented generally vertically and faces forward so that the sheets in the stack will confront the viewing location; and restraining means on the tray adjacent the opening, the restraining means including at least one restraining element movable between an open position, wherein the restraining element is adjacent the opening outside the area of the opening for enabling unrestricted passage of the sheets through the opening into and out of the receptacle, and a closed position, wherein the restraining element overlaps the area of the opening for restraining passage of the sheets through the opening out of the receptacle, and gravity-biased means for moving the restraining element from the open position into the closed position in response to placement of the tray in the second position.

The invention will be understood more fully, while still further objects and advantages will become apparent, in the following detailed description of a preferred embodiment of the invention illustrated in the accompanying drawing, in which.

Figure 1:
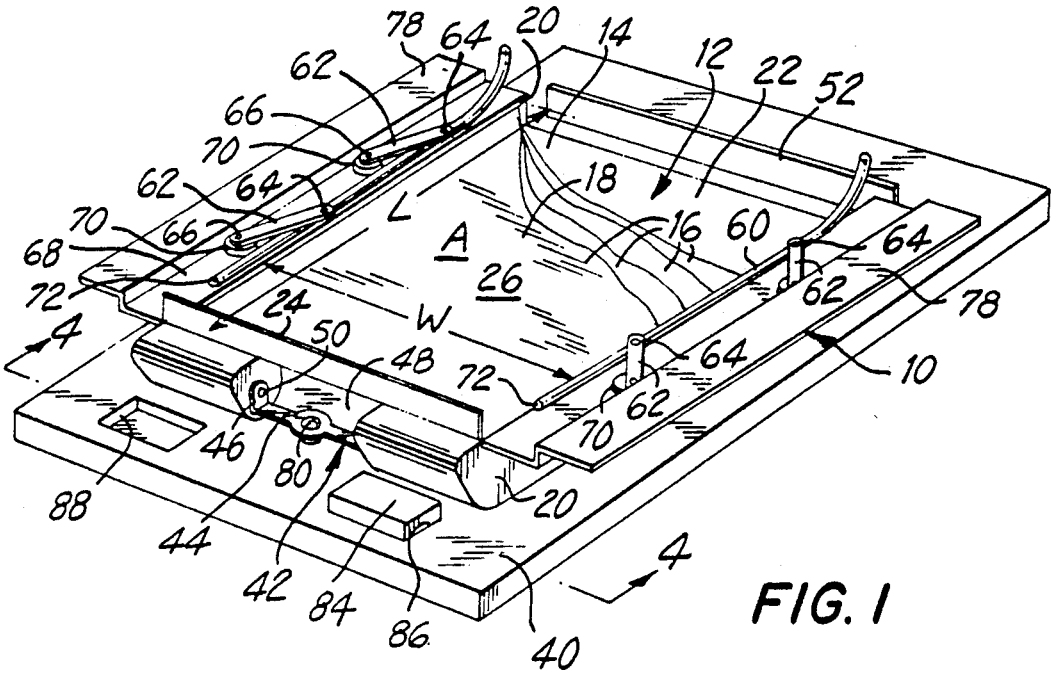
FIG. 1 is a perspective view of a document holder constructed in accordance with the present invention.

Referring now to the drawing, and especially to FIG. 1 thereof, a document holder constructed in accordance with the invention is illustrated generally at 10 and is seen to include a tray 12 having a receptacle 14 within which there is placed a plurality of documents shown in the form of individual sheets 16 held in a stack 18. The sheets 16 have a longitudinal length L and a lateral width W which, together, define an area A. The documents are to be reviewed by viewing information appearing within the area A of each sheet 16. Tray 12 has laterally spaced apart side walls 20 which, in the position illustrated in FIG. 1, extend upwardly from the bottom 22 of the tray 12. The receptacle 14 is established by the bottom 22, the side walls 20 and an end wall 24, and an opening 26 into the receptacle 14 faces upwardly, when tray 12 is in the position shown in FIG. 1, so that the stack 18 of sheets 16 may be placed in the receptacle 14 merely by dropping the sheets 16 downwardly through the opening 26, and may be removed from the receptacle 14 merely by lifting the sheets 16 upwardly through the opening 26. Thus, the area of the opening 26 corresponds essentially to the area A of the sheets 16. Insofar as the above description is concerned, the tray 12 operates in much the same fashion as a common "IN" or "OUT" tray or basket.

Figure 8:
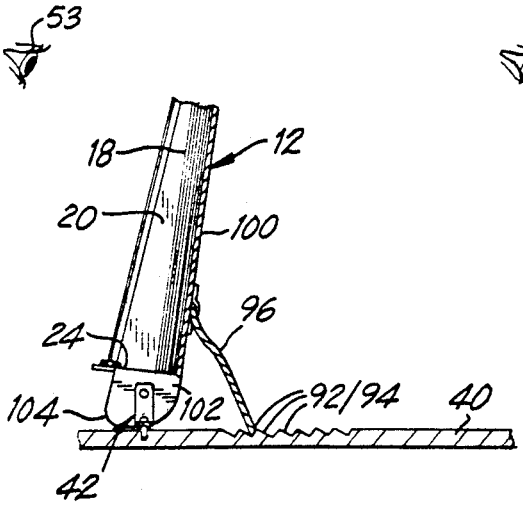
Figure 9:
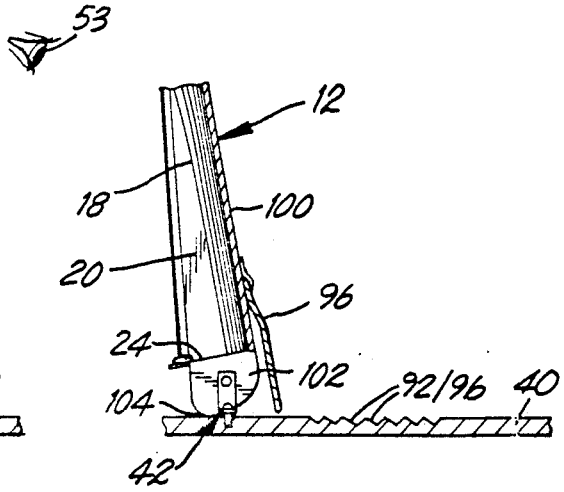

Tray 12 is mounted upon a base 40 by means of a bracket 42 which includes a central cross-member 44 and a pair of ears 46 extending upwardly from the cross-member 44 into a notch 48 in the end wall 24 of the tray 12. A pivot pin 50 interconnects each ear 46 with the end wall 24 of the tray 12 so that the tray 12 may be moved selectively between a first position illustrated in FIG. 1, wherein the tray 12 is oriented generally horizontally, and a second position illustrated in FIG. 2, wherein the tray 12 is oriented generally vertically. In the generally horizontal orientation of the tray 12, the sheets 16 are maintained in the stack 18 in the receptacle 14 by the side walls 20, the end wall 24, and by an opposite end wall 52 integral with base 40. Sheets 16 freely are dropped into the tray 12 and lifted out of tray 12. In the essentially vertical orientation of tray 12, the opening 26 faces forward so that the stack 18 of sheets 16 confronts the location 53 (see FIGS. 8 and 9) from which the sheets 16 are to be viewed during a visual scan and review of the documents, and the end of the stack 18 opposite the end wall 24 is accessible by virtue of end opening 54, made available by leaving behind the corresponding end wall 52. The sheets 16 thus are made available for ready visual scanning through the stack 18 and the review is facilitated.

Figure 2:
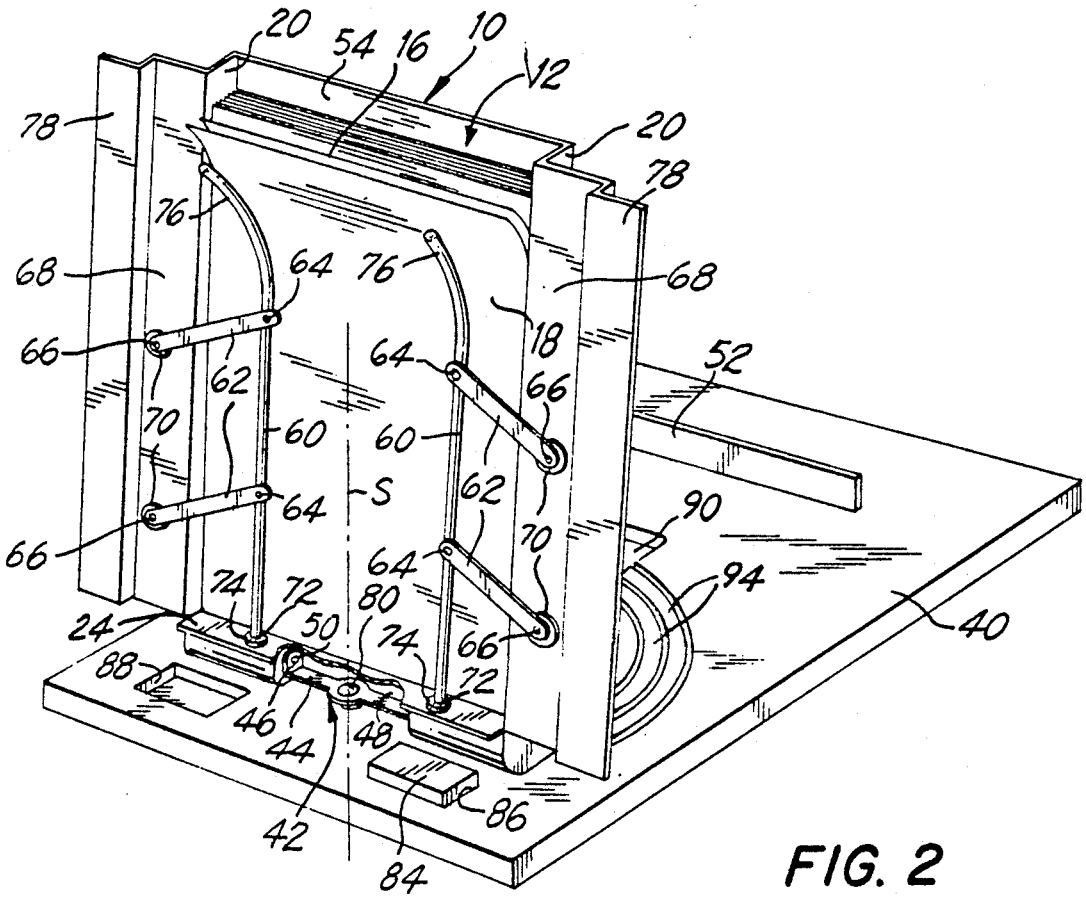
FIG. 2 is a perspective view of the document holder, with component parts in another operating position.

In order to retain the stack 18 in the tray 12 when the tray 12 is in the orientation shown in FIG. 2, restraining means are provided on the tray 12 and include restraining elements in the form of a pair of bars 60. Each bar 60 is mounted upon the tray 12 for movement between an open or retracted position of the bar 60 illustrated in FIG. 1, wherein the bars 60 extend generally parallel to the respective side walls 20 and are outside the area of the opening 26 for unrestricted access to the receptacle 14 and uninhibited passage of the sheets 16 through the opening 26 into the receptacle 14, and a closed or extended position of the bar 60 illustrated in FIG. 2, wherein the bars 60 still are generally parallel to the respective side walls 20, but are displaced inwardly to overlap the area of the opening 26 and restrain passage of the sheets 16 out of the receptacle 14. Operation of the document holder 10 is facilitated by a mechanism which enables the bars 60 to move from the retracted position illustrated in FIG. 1 to the extended position illustrated in FIG. 2 by gravity-biased means which operate in response to placement of the tray 12 in the second position. Thus, each bar 60 has a given weight and is connected to a pair of links 62 by pivotal connections at 64, and the links 62 are connected to corresponding side walls 20 by pivotal connections 66 at flange portions 68 which extend laterally outwardly along the side walls 20, so that upon movement of the tray 12 from the first position thereof, as shown in FIG. 1, to the second position thereof, as shown in FIG. 2, the bars 60 are moved, by the force of gravity, from the retracted position of FIG. 1 to the extended position of FIG. 2. Movement of the bars 60 to the extended position is facilitated by low-friction bearings 70. Upon movement of bars 60 to the extended position, the lower end 72 of each bar 60 comes to rest upon a respective resilient, shock-absorbing pad 74 secured to end wall 24, for quiet operation. In the extended position, the bars 60 restrain forward movement of the sheets 16 out of the receptacle 14 of tray 12 and enable review of the sheets 16 while the stack 18 is retained in the receptacle 14. The review of the sheets 16 is facilitated by providing the upper end of each bar 60 with a curved configuration 76, so that at least the upper end of each of the individual sheets 16 may be pulled forward for the viewing of at least the file title of each subsequent sheet 16 in the stack 18. Any of the sheets 16 may be removed from stack 18 or inserted into stack 18 through end opening 54 for selective arrangement of the sequence of sheets 16 within the stack 18, while the stack 18 is retained in the tray 12 by the bars 60. Lateral extensions 78 on the side walls 20 provide convenient finger grips for manipulating the tray 12 between the illustrated positions.

Figure 3:
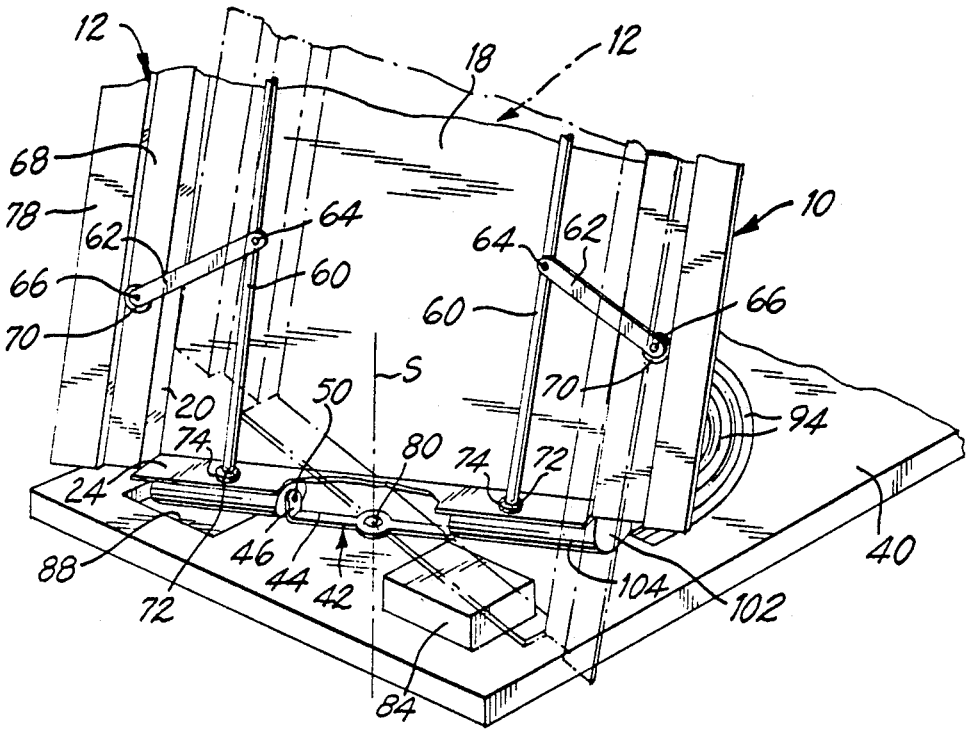
FIG. 3 is a fragmentary perspective view of a portion of the document holder illustrating another operating position of the component parts.
Figure 4:
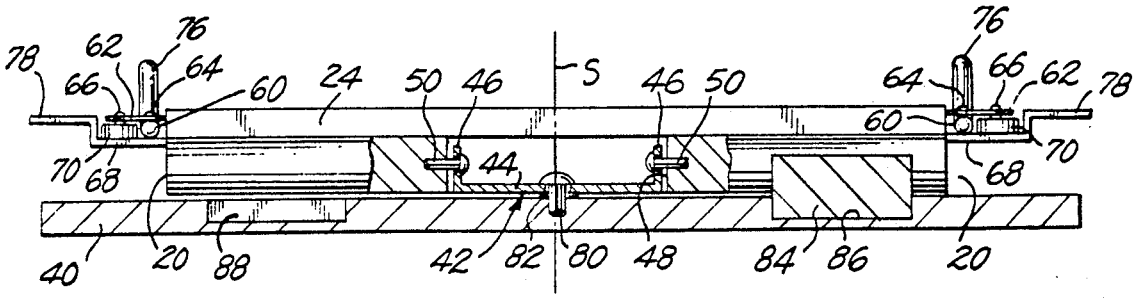
FIG. 4 is a cross-sectional view taken along line 4—4 of FIG. 1.

In addition to movement of the tray 12 between the first and second positions illustrated in FIGS. 1 and 2, the tray 12 may be swivelled, or swung, from side to side for accommodating viewing of the documents in the tray 12 where the document holder 10 is placed off to one side of a desk top, a table top or another work surface. Thus, bracket 42 is mounted upon base 40 for swinging movement about an essentially vertical axis S by means of a vertical post 80 which passes through cross-member 44 and into base 40 in such a way a to enable swiveling of the bracket 42 upon the base 40 about axis S. As best seen in FIGS. 3 and 4, the tray 12 may be swung about axis S along a path extending away from the central position of the tray 12 illustrated in FIGS. 1 and 2, by grasping either one or both of the lateral extensions 78 and swiveling the tray 12 about the pin 80. A bushing 82 eases the swiveling motion. The arrangement of post 80 and bracket 42 allows swinging movement in either direction away from the central position of tray 12, as illustrated by the left-of-center position shown in full lines in FIG. 3 and the right-of-center position shown in phantom in FIG. 3, for the convenience of the worker viewing the documents. However, a stop in the form of block 84 fitted selectively into one of the two recesses 86 or 88 restricts swinging to a selected one of the left or right directions and serves to define the central position of the tray 12, for purposes which will be set forth below.

Figure 5:
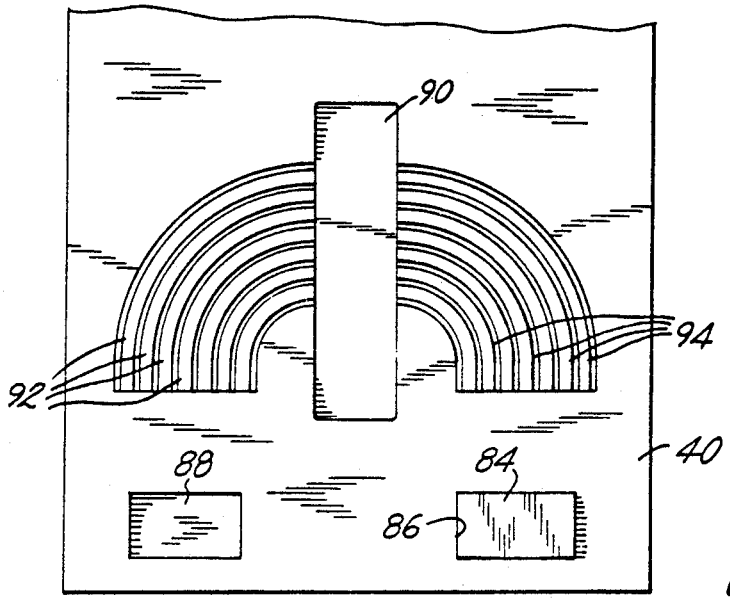
FIG. 5 is a top plan view of the base of the document holder.

Turning now to FIG. 5, and to FIGS. 6 through 9, base 40 is provided with a central longitudinal groove 90, a series of arcuate abutments 92 running from the central longitudinal groove 90 to the left of the groove 90, and a series of arcuate abutments 94 running from the central longitudinal groove 90 to the right of the groove 90. A prop 96 is hinged at 98 to the lower face 100 of the tray 12 and may be engaged with any selected one of the abutments 92 and 94 to support tray 12 at any one of a plurality of intermediate propped-up positions between a fully-down position and a fully-up position, as illustrated in FIGS. 1 and 2, and the corresponding illustrations in FIGS. 6 through 9. In all of the intermediate positions of tray 12, the flange portions 68 of the side walls 20 are sloped forward so that the bars 60 are biased toward the extended position of the bars 60. At the limit of upward and forward movement illustrated in FIG. 9, the tray 12 is supported in position by the contour of extension 102 of the end wall 24 which provides a lobe 104 for abutting the base 40 to retain the tray 12 in place. In each of the propped-up positions, the tray 12 is swung either to the left or to the right of center. When the tray 12 is returned to the central position, the prop 96 is placed in the central groove 90 and allows lowering of the tray 12 to the generally horizontal position shown in FIG. 1. In order to facilitate location of the tray 12 at the central position for lowering, the worker may select the appropriate placement of block 84, either in recess 86 or 88, so as to enable the desired swiveling movement to either the left or the right and a positive indication of the return to the central position.

Figure 6:
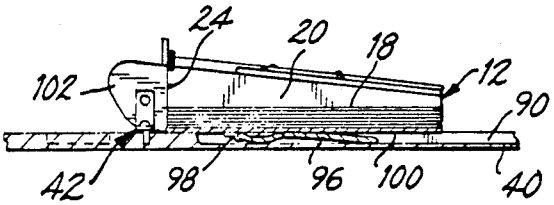
FIGS. 6 through 9 are partially diagrammatic longitudinal cross-sectional views demonstrating operation of the document holder.
Figure 7:
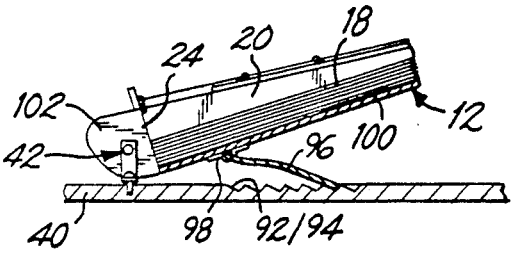

Referring now to FIG. 6, as well as to FIG. 1, upon placement of the tray 12 at the first position, bars 60 are biased by gravity toward the location where the bars 60 are adjacent the side walls 20, and away from the opening 26 for unrestricted access to the receptacle 14. Thus, the flange portions 68 of the side walls 20 are sloped rearwardly, relative to the generally horizontal orientation of the tray 12, so that the weight of the bars 60 enables the force of gravity to move the bars 60 to the retracted position of the bars 60. In this manner, operation of the means which restrains the sheets 16 of stack 18 in the document holder 10 is fully automatic and requires only manipulation of the tray 12 to the position most convenient for use by a particular worker.

It will be seen that the document holder 10 attains several objects and advantages, among which are those summarized as follows: Permits documents to be held within easy reach and with maximum accessibility for review and further processing; promotes neatness and convenience in the processing of routine paperwork at a desk, table or other work station; enables ease of operation for expeditious review and handling of documents; provides a simplified construction readily adapted to a variety of document processing procedures for widespread economical use; relieves a large part of the tedium connected with document review for increased efficiency and accuracy; enables better organization of individual documents for retention and review; provides increased flexibility of use, enabling adaptation to the needs of a wide variety of document retention and review procedures; maintains an aesthetically pleasing as well as neat work space.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A document holder for holding documents in the form of a stack of individual sheets selectively viewable from a viewing location forward of the stack, while being maintained in the stack, the sheets each having a length and a width defining a prescribed area, the document holder comprising:

a tray having a receptacle for receiving the stack of sheets, the receptacle including an opening through which the sheets are passed into and out of the receptacle, the opening having an area great enough relative to the area of each sheet to be received within the receptacle so as to enable essentially uninhibited passage of the sheets through the opening into and out of the receptacle;

orienting means on the tray for enabling the tray to be moved between a generally horizontal first position, wherein the opening is oriented generally horizontally and faces upwardly, so that the sheets may be dropped essentially downwardly through the opening into the receptacle, and a generally vertical second position, wherein the opening is oriented generally vertically and faces forward so that the sheets in the stack will confront the viewing location; and restraining means on the tray adjacent the opening, the restraining means including at least one restraining element movable between an open position, wherein the restraining element is adjacent the opening outside the area of the opening for enabling unrestricted passage of the sheets through the opening into and out of the receptacle, and a closed position, wherein the restraining element overlaps the area of the opening for restraining passage of the sheets through the opening out of the receptacle, and gravity-biased means coupled with the tray and with the restraining element for moving the restraining element from the open position into the closed position in response to placement of the tray in the second position.

2. The invention of claim 1 wherein the gravity-biased means includes further means coupled with the tray and with the restraining element for moving the restraining element from the closed position into the open position in response to placement of the tray in the first position.

3. The invention of claim 1 wherein the restraining element includes a bar having a given weight, and the restraining means includes interconnecting means interconnecting the bar with the tray such that the weight of the bar will move the bar over the area of the opening to place the restraining element into the closed position.

4. The invention of claim 3 wherein the interconnecting means includes at least one link and pivot means connecting the link between the bar and the tray such that upon placement of the tray in the second position, the bar will be biased by gravity and the link will pivot to place the bar over the area of the opening.

5. The invention of claim 1 wherein the document holder includes a base, and the orienting means includes mounting means for mounting the tray on the base for movement relative to the base between the first and second positions of the tray, and prop means for propping the tray in the second position thereof upon the base.

6. The invention of claim 5 wherein the mounting means includes swinging means for enabling swinging of the tray relative to the base about a generally vertical axis along a path extending from a central position toward either one of a left position left of the central position and a right position right of the central position.

7. A document holder for holding documents in the form of a stack of individual sheets selectively viewable from a viewing location forward of the stack, while being maintained in the stack, the sheets each having a length and a width defining a prescribed area, the document holder comprising:

a tray having a receptacle for receiving the stack of sheets, the receptacle including an opening through which the sheets are passed into and out of the receptacle, the opening having an area great enough relative to the area of each sheet to be received within the receptacle so as to enable essentially uninhibited passage of the sheets through the opening into and out of the receptacle;

orienting means on the tray for enabling the tray to be moved between a generally horizontal first position, wherein the opening is oriented generally horizontally and faces upwardly, so that the sheets may be dropped essentially downwardly through the opening into the receptacle, and a generally vertical second position, wherein the opening is oriented generally vertically and faces forward so that the sheets in the stack will confront the viewing location; and restraining means on the tray adjacent the opening, the restraining means including at least one restraining element movable between an open position, wherein the restraining element is adjacent the opening outside the area of the opening for enabling unrestricted passage of the sheets through the opening into and out of the receptacle, and a closed position, wherein the restraining element overlaps the area of the opening for restraining passage of the sheets through the opening out of the receptacle, and gravity-biased means for moving the restraining element into the closed position in response to placement of the tray in the second position; and wherein the restraining element includes a bar having a given weight, and the restraining means includes interconnecting means interconnecting the bar with the tray such that the weight of the bar will move the bar over the area of the opening to place the restraining element into the closed position;

the interconnecting means includes at least one link and pivot means connecting the link between the bar and the tray such that upon placement of the tray in the second position, the bar will be biased by gravity and the link will pivot to place the bar over the area of the opening; and the tray includes opposite sides spaced apart horizontally and extending generally vertically when the tray is in the second position so as to be sloped forwardly, relative to the generally horizontal orientation of the tray in the first position, and the bar extends longitudinally generally parallel to one of the opposite sides and is displaced laterally upon movement of the tray between the first and second positions of the tray as a result of the forward slope of the one of the opposite sides of the tray.

8. The invention of claim 7 wherein the restraining means includes one said bar and corresponding interconnecting means associated with each of the opposite sides of the tray.

9. The invention of claim 7 wherein the gravity-biased means includes further means for moving the restraining element into the open position in response to placement of the tray in the first position, the further means including slope means establishing a rearward slope in the sides of the tray, relative to the generally horizontal orientation of the tray, when the tray is in the first position, such that the bar is biased by gravity laterally out of the area of the opening upon movement of the tray to the first position.

10. The invention of claim 9 wherein the restraining means includes one said bar and corresponding interconnected means associated with each of the opposite sides of the tray.

11. A document holder for holding documents in the form of a stack of individual sheets selectively viewable from a viewing location forward of the stack, while being maintained in the stack, the sheets each having a length and a width defining a prescribed area, the document holder comprising:

a tray having a receptacle for receiving the stack of sheets, the receptacle including an opening through which the sheets are passed into and out of the receptacle, the opening having an area great enough relative to the area of each sheet to be received within the receptacle so as to enable essentially uninhibited passage of the sheets through the opening into and out of the receptacle;

orienting means on the tray for enabling the tray to be moved between a generally horizontal first position, wherein the opening is oriented generally horizontally and faces upwardly, so that the sheets may be dropped essentially downwardly through the opening into the receptacle, and a generally vertical second position, wherein the opening is oriented generally vertically and faces forward so that the sheets in the stack will confront the viewing location; and restraining means on the tray adjacent the opening, the restraining means including at least one restraining element movable between an open position, wherein the restraining element is adjacent the opening outside the area of the opening for enabling unrestricted passage of the sheets through the opening into and out of the receptacle, and a closed position, wherein the restraining element overlaps the area of the opening for restraining passage of the sheets through the opening out of the receptacle, and gravity-biased means for moving the restraining element into the closed position in response to placement of the tray in the second position; and wherein the document holder includes a base, and the orienting means includes mounting means for mounting the tray on the base for movement relative to the base between the first and second positions of the tray, and prop means for propping the tray in the second position thereof upon the base;

the mounting means includes swinging means for enabling swinging of the tray relative to the base about a generally vertical axis along a path extending from a central position toward either one of a left position left of the central position and a right position right of the central position; and the prop means includes a prop extending from the tray for resting against the base to prop the tray in the second position, and abutment means on the base and located for engagement by the prop when the tray is in either one of the left position and the right position.

12. The invention of claim 11 includ'ng a stop selectively placed in the path of swinging movement of the tray to define the central position.

* * * * *